US008104318B2

(12) United States Patent
Hiramoto et al.

(10) Patent No.: US 8,104,318 B2
(45) Date of Patent: Jan. 31, 2012

(54) EXTRUSION DIE FOR METALLIC MATERIAL

(75) Inventors: Kimihisa Hiramoto, Oyama (JP); Hidekazu Sakihama, Oyama (JP)

(73) Assignee: Showa Denko K.K., Tokyo (JP)

( * ) Notice: Subject to any disclaimer, the term of this patent is extended or adjusted under 35 U.S.C. 154(b) by 839 days.

(21) Appl. No.: 11/667,306

(22) PCT Filed: Sep. 8, 2006

(86) PCT No.: PCT/JP2006/318325
§ 371 (c)(1),
(2), (4) Date: May 9, 2007

(87) PCT Pub. No.: WO2007/029888
PCT Pub. Date: Mar. 15, 2007

(65) Prior Publication Data

US 2007/0283736 A1 Dec. 13, 2007

Related U.S. Application Data

(60) Provisional application No. 60/716,505, filed on Sep. 14, 2005.

(30) Foreign Application Priority Data

Sep. 8, 2005 (JP) ..... 2005-260806

(51) Int. Cl.
*B21C 23/04* (2006.01)

(52) U.S. Cl. ..... 72/264

(58) Field of Classification Search ..... 72/253.1, 72/260, 264, 266, 268, 269, 467, 478
See application file for complete search history.

(56) References Cited

U.S. PATENT DOCUMENTS

| | | | | |
|---|---|---|---|---|
| 3,748,885 | A | 7/1973 | Creuzet | |
| 4,976,130 | A * | 12/1990 | Oki et al. | 72/269 |
| 5,061,163 | A * | 10/1991 | Kennedy | 72/269 |
| 5,337,593 | A * | 8/1994 | Yano | 72/269 |
| 7,093,474 | B2 | 8/2006 | Hiramoto et al. | |

FOREIGN PATENT DOCUMENTS

| | | |
|---|---|---|
| EP | 0 377 947 A2 | 7/1990 |
| EP | 0 377 947 A3 | 7/1990 |
| JP | 49 46707 | 12/1974 |
| JP | 53 102938 | 8/1978 |

(Continued)

*Primary Examiner* — Teresa Ekiert
(74) *Attorney, Agent, or Firm* — Oblon, Spivak, McClelland, Maier & Neustadt, L.L.P.

(57) ABSTRACT

In some preferred embodiments, an extrusion die for metallic material capable of obtaining a high quality extruded article can be provide while securing sufficient strength and durability. The extrusion die is provided with a die holding case 20 having a dome portion 21 with an external surface functioning as a metallic material pressure receiving surface 22, the metallic material pressure receiving surface 22 being disposed so as to face rearward, a male die 30 held in the die holding case 21, and a female die 40 held in a front portion of the die holding case 20. The metallic material pressure receiving surface 22 is formed into a convex configuration, and a porthole 24 is formed in the dome portion 21. The central axis A2 of the porthole 24 is inclined to the central axis A1 of the die holding case 20. The metallic material pressed against the metallic material pressure receiving surface 22 is introduced into the die holding case 20 through the porthole 24 and passes through the extrusion hole 11.

17 Claims, 13 Drawing Sheets

FOREIGN PATENT DOCUMENTS

| | | |
|---|---|---|
| JP | 1-99716 | 4/1989 |
| JP | 2 280912 | 11/1990 |
| JP | 6-142755 | 5/1994 |
| JP | 6-81644 | 10/1994 |
| JP | 2003-200212 | 7/2003 |
| JP | 2004-306124 | 11/2004 |
| TW | 436342 | 5/2001 |
| TW | M271631 | 8/2005 |

* cited by examiner

EXTRUSION DIE FOR METALLIC MATERIAL

This application claims priority to Japanese Patent Application No. 2005-260806 filed on Sep. 8, 2005 and U.S. Provisional Application Ser. No. 60/716,505 filed on Sep. 14, 2005, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application Ser. No. 60/716,505 filed on Sep. 14, 2005, pursuant to 35 U.S.C. §111(b).

TECHNICAL FIELD

The present invention relates to an extrusion die for use in metallic material extrusion.

BACKGROUND ART

The following description sets forth the inventor's knowledge of related art and problems therein and should not be construed as an admission of knowledge in the prior art.

As an extrusion die for manufacturing a metal hollow extruded product, such as, e.g., an aluminum heat exchanging tube for use in a heat exchanger for car air-conditioners, there are a porthole die as shown in FIG. 16A, a spider die as shown in FIG. 16B, and a bridge die as shown in FIG. 16C.

In these extrusion dies, a male die 1 and a female die 2 are combined with the mandrel 1*a* of the male die 1 placed in the corresponding die hole 2*a* of the female die 2 to define a circular extrusion hole by and between the mandrel 1*a* and the die hole 2*a*. A metal billet (metallic material) pressed against the billet pressure receiving surface of the male die 1 is introduced into both the dies 1 and 2 via material introduction holes 1*c* formed in the male die 1 and then passed through the extrusion hole while being plastically deformed, so that an extruded member having a cross-section corresponding to the cross-sectional configuration of the extrusion hole is formed.

In such an extrusion die, since a large stress due to the pressing of the metal billet is applied to the billet pressure receiving surface 1*b* of the male die 1, the stress may cause a generation of cracks in the billet pressure receiving surface and therearound, which in turn may result in insufficient die life.

Under the circumstances, an extrusion die for metallic material as disclosed by the below-listed Patent Documents 1 and 2 is conventionally proposed. This is a bridge die with the bridge portion of the male die fitted to the female die. In this die, the billet pressure receiving surface of the male die is formed into a convex configuration which projects in a direction opposite to the extrusion direction of the billet to avoid adverse effects due to the pressing of the metal billet by receiving the pressing force of the metal billet in a pressing force reduced manner with the convex surface.

Patent Document 1: Japanese Unexamined Laid-open Utility Model Publication No. S53-102938 (see claims, and FIGS. 3 to 5)

Patent Document 2: Japanese Unexamined Laid-open Patent Document No. H02-280912 (see claims and FIGS. 1 to 3)

In the conventional extrusion die shown in the aforementioned Patent Documents 1 and 2, since the billet pressure receiving surface is formed into a convex configuration, the bridge portion is insufficient in strength, although the strength of the male die, such as the resistance to pressure against a metal billet, is improved to some extent. Therefore, in order to secure sufficient strength of the bridge portion, the size of the male die such as the thickness of the bridge portion has to be increased beyond necessity, which results in not only an increased size and weight but also an increased cost.

Especially in the case of extruding an extruded article having a complicated configuration using an extrusion die, it is necessary to stably and smoothly introduce the metal material into the extrusion hole from the material introducing portion. In the aforementioned conventional extrusion die, however, the metallic material which flows from the material introducing portion of the male die into the space between the male die and the female die is disturbed by the bridge portion of the male die. This prevents smooth introduction of the metallic material, causing deteriorated dimensional accuracy of the extruded article, which in turn makes it difficult to attain high quality.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

Other objects and advantages of the present invention will be apparent from the following preferred embodiments.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

The present invention was made to solve the aforementioned problems of the conventional technique, and aims to provide an extrusion die for metallic material capable of obtaining a high quality extruded article while reducing the cost and size of the die and securing sufficient strength and durability of the die.

The present invention also aims to provide an extrusion die for a heat exchanging tube capable of attaining the aforementioned purposes, an extrusion method for extruding metallic material, an extrusion method for a heat exchanging tube, an extruder for metallic material, and an extruder for producing a heat exchanging tube.

The present invention provides the following means to attain the aforementioned objects.

[1] An extrusion die for metallic material, comprising:

a die holding case having a dome portion with an external surface functioning as a metallic material pressure receiving surface, the metallic material pressure receiving surface of the dome portion being disposed so as to face rearward against an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, and a central axis of the porthole is inclined to a central axis of the die holding case so that the central axis of the porthole gradually approaches the central axis of the die holding case toward a downstream side, and wherein the metallic material pressed against the metallic material pressure receiving surface is introduced into the die holding case through the porthole and passes through the extrusion hole.

[2] The extrusion die for metallic material as recited in the aforementioned Item 1, wherein the metallic material pressure receiving surface is constituted by a convex spherical surface which is a part of a spherical surface.

[3] The extrusion die for metallic material as recited in the aforementioned Item 1 or 2, wherein the metallic material pressure receiving surface is constituted by a convex spherical surface of a ⅙ to ⅚ sphere.

[4] The extrusion die for metallic material as recited in any one of the aforementioned Items 1 to 3, wherein a plurality of portholes are formed about the central axis of the die holding case at regular intervals in a peripheral direction of the die holding case.

[5] The extrusion die for metallic material as recited in any one of the aforementioned Items 1 to 4, wherein the porthole is arranged toward the extrusion hole.

[6] The extrusion die for metallic material as recited in any one of the aforementioned Items 1 to 5, wherein the central axis of the porthole is set to 10 to 35° in inclination angle to the central axis of the die holding case.

[7] The extrusion die for metallic material as recited in any one of the aforementioned Items 1 to 6, wherein a flat circular extrusion hole small in height (thickness) with respect to a width is formed by and between the mandrel of the male die and the die hole of the female die, and wherein a portion of the mandrel corresponding to the die hole is formed into a comb configuration having a plurality of passage forming protrusions arranged in a width direction, whereby the metallic material is passed through the extrusion hole to thereby extrude a multi-bored hollow member having a plurality of passages arranged in a width direction.

[8] The extrusion die for metallic material as recited in the aforementioned Item 7, wherein the multi-bored hollow member is used as a heat exchanging tube for a heat exchanger.

[9] The extrusion die for metallic material as recited in any one of the aforementioned Items 1 to 8, wherein a flat circular extrusion hole small in height with respect to a width is formed by and between the mandrel of the male die and the die hole of the female die, and wherein the portholes are arranged at positions corresponding to both sides in a height direction (thickness direction) of the extrusion hole.

[10] The extrusion die for metallic material as recited in any one of the aforementioned Items 1 to 9, wherein the die holding case has, at its front portion, a circular base portion integrally formed with the dome portion.

[11] The extrusion die for metallic material as recited in any one of the aforementioned Items 1 to 10, wherein the metallic material is aluminum or its alloy.

[12] An extrusion die for extruding a heat exchanging tube having a plurality of passages arranged in a width direction, the extrusion die comprising:

a die holding case having a dome portion with an external surface functioning as a metallic material pressure receiving surface, the metallic material pressure receiving surface of the dome portion being disposed so as to face rearward against an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, and a central axis of the porthole is inclined to a central axis of the die holding case so that the central axis of the porthole gradually approaches the central axis of the die holding case toward a downstream side, wherein a portion of the mandrel corresponding to the die hole is formed into a comb configuration having a plurality of passage forming protrusions, and wherein the metallic material pressed against the metallic material pressure receiving surface is introduced into the die holding case through the porthole and passes through the extrusion hole to thereby form the heat exchanging tube having a plurality of passages arranged in the width direction.

[13] A method of extruding metallic material, comprising:

preparing a die holding case having a dome portion with an external surface functioning as a metallic material pressure receiving surface, the metallic material pressure receiving surface of the dome portion being disposed so as to face rearward against an extrusion direction of the metallic material, a male die having a mandrel held in the die holding case and positioned on a central axis of the die holding case, and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, and wherein a central axis of the porthole is inclined to a central axis of the die holding case so that the central axis of the porthole gradually approaches the central axis of the die holding case toward a downstream side; and introducing the metallic material pressed against the metallic material pressure receiving surface into the die holding case through the porthole to pass through the extrusion hole.

[14] An extrusion method for manufacturing a heat exchanging tube having a plurality of passages arranged in a width direction of the heat exchanging tube, the extrusion method comprising:

preparing a die holding case having a dome portion with an external surface functioning as a metallic material pressure receiving surface, the metallic material pressure receiving surface of the dome portion being disposed so as to face rearward against an extrusion direction of the metallic material, a male die having a mandrel held in the die holding case and positioned on a central axis of the die holding case, and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, wherein a central axis of the porthole is inclined to a central axis of the die holding case so that the central axis of the porthole gradually approaches the central axis of the die holding case toward a downstream side, and wherein a portion of the mandrel corresponding to the die hole is formed into a comb configuration having a plurality of passage forming protrusions; and introducing the metallic material pressed against the metallic material pressure receiving surface into the die holding case through the porthole to pass through the extrusion hole to thereby form the heat exchanging tube having a plurality of passages arranged in a width direction.

[15] An extruder for metallic material equipped with a container and an extrusion die mounted in the container in which the metallic material is supplied to the extrusion die, wherein the extrusion die comprises:

a die holding case having a dome portion with an external surface functioning as a metallic material pressure receiving surface, the metallic material pressure receiving surface of the dome portion being disposed so as to face rearward against an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, and a central axis of the porthole is inclined to a central axis of the die holding case so that the central axis of the porthole gradually approaches the central axis of the die holding case toward a downstream side, and wherein the metallic material pressed against the metallic material pressure receiving surface pressed is introduced into the die holding case through the porthole and passes through the extrusion hole.

[16] An extruder for producing a heat exchanging tube equipped with a container and an extrusion die mounted in the container in which the metallic material is supplied to the extrusion die, wherein the extrusion die comprises:

a die holding case having a dome portion with an external surface functioning as a metallic material pressure receiving surface, the metallic material pressure receiving surface of the dome portion being disposed so as to face rearward against an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, wherein a porthole for introducing the metallic material is formed in a periphery of the dome portion, and a central axis of the porthole is inclined to a central axis of the die holding case so that the central axis of the porthole gradually approaches the central axis of the die holding case toward a downstream side, wherein a portion of the mandrel corresponding to the die hole is formed into a comb configuration having a plurality of passage forming protrusions, and wherein the metallic material pressed against the metallic material pressure receiving surface is introduced into the die holding case through the porthole and passes through the extrusion hole to thereby form the heat exchanging tube having a plurality of passages arranged in a width direction.

[17] An extrusion die for metallic material, comprising:

a die case having a dome portion with an external surface functioning as a metallic material pressure receiving surface, the metallic material pressure receiving surface of the dome portion being disposed so as to face rearward against an extrusion direction of the metallic material;

a male die held in the die case and positioned on a central axis of the die case; and a female die held in a front portion of the die case, the female die defining an extrusion hole by and between the female die and the male die, wherein the metallic material pressure receiving surface of the dome portion is formed into a convex configuration protruded rearward, wherein a porthole for introducing the metallic material is formed in a periphery of the dome portion, and a central axis of the porthole is inclined to a central axis of the die case so that the central axis of the porthole gradually approaches the central axis of the die case toward a downstream side, and wherein the metallic material pressed against the metallic material pressure receiving surface pressed is introduced into the die case through the porthole and passes through the extrusion hole.

In the constitution as recited in this Item [17], the constitutions of the aforementioned Items [2] to [11] can be subordinated.

Effects of the Invention

According to the extrusion die for metallic material as recited in the aforementioned Item [1], since the metallic material pressure receiving surface is formed into a convex configuration, when the metallic material is pressed against the pressure receiving surface, the pressing force of the metallic material can be received by being distributed by a convex surface, which in turn can reduce the pressing force at each portion of the pressure receiving surface in the direction of the normal line. Therefore, the strength to the pressing force of the metallic material can be improved, resulting in sufficient durability.

Furthermore, in this invention, since the porthole for introducing the material is formed in the dome portion of the die U holding case covering the male die and the female die, i.e., since the front end (downstream side) wall portion of the dome portion is integrally formed in the peripheral direction, the existence of this continued peripheral wall portion can markedly increase the strength of the die holding case, which in turn can further increase the entire strength of the extrusion die. Accordingly, in the die according to this invention, a portion weak in strength, such as, e.g., a conventional bridge portion, does not exist, and therefore it is not required to unnecessarily increase a size, such as, e.g., a thickness, to improve the strength, which makes it possible to attain the reduced size and weight and the cost reduction.

Furthermore, in this invention, since the porthole is formed in a periphery of the dome portion and the central axis of the porthole is inclined to the central axis of the die holding case so as to gradually approach the central axis of the die holding case toward the downstream side, the metallic material passing through the porthole can be stably extruded while being smoothly introduced to the axial center A1, i.e., the extrusion hole. Therefore, extrusion molding can be performed in a stable manner, which enables to obtain a high quality extruded member.

According to the extrusion die for metallic material as recited in the aforementioned Item [2], since the metallic material pressure receiving surface is constituted by the convex spherical surface, the pressing force of the metallic material to the pressure receiving surface can be distributed in a well-balanced manner, which makes it possible to improve the strength to the metallic material.

According to the extrusion die for metallic material as recited in the aforementioned Item [3], since the metallic material pressure receiving surface is constituted by the specific convex spherical surface, the pressing force of the metallic material to the pressure receiving surface can be assuredly distributed in a well-balanced manner, which makes it possible to assuredly improve the strength to the metallic material.

According to the extrusion die for metallic material as recited in the aforementioned Item [4], since a plurality of portholes are formed in the peripheral direction, the metallic material can be uniformly introduced from the periphery into the die holding case, resulting in smooth supplying of the metallic material to the extrusion hole, thereby enabling a more steady extrusion.

According to the extrusion die for metallic material as recited in the aforementioned Item [5], since the porthole is faced to the extrusion hole, the metallic material flowed into the porthole can be more smoothly supplied to the extrusion hole.

According to the extrusion die for metallic material as recited in the aforementioned Item [6], since the central axis of the porthole is set to a specific inclination angle, the metallic material can be supplied from the porthole to the extrusion hole in a more stabilized manner.

According to the extrusion die for metallic material as recited in the aforementioned Item [7], a multi-bored hollow member having a plurality of passages arranged in parallel in the width direction can formed assuredly.

According to the extrusion die for metallic material as recited in the aforementioned Item [8], a tube for a heat exchanger can be obtained assuredly.

According to the extrusion die for metallic material as recited in the aforementioned Item [9], the metallic material can be supplied from the porthole to the flat extrusion hole in a more stabilized manner.

According to the extrusion die for metallic material as recited in the aforementioned Item [10], since the circular base portion is integrally formed to the dome portion, the die holding case can be reinforced by the circular base portion, which in turn can further improve the entire strength of the extrusion die.

According to the extrusion die for metallic material as recited in the aforementioned Item [11], an extruded product made of aluminum or aluminum alloy can be manufactured.

According to the invention as recited in the aforementioned Item [12], an extrusion die for a heat exchanging tube having the same effects as mentioned above can be provided.

According to the invention as recited in the aforementioned Item [13], an extrusion molding method for metallic material having the same effects as mentioned above can be provided.

According to the invention as recited in the aforementioned Item [14], an extrusion method for manufacturing a heat exchanging tube having the same effects as mentioned above can be provided.

According to the invention as recited in the aforementioned Item [15], an extruder for metallic material having the same effects as mentioned above can be provided.

According to the invention as recited in the aforementioned Item [16], an extruder for producing a heat exchanging tube having the same effects as mentioned above can be obtained.

According to the invention as recited in the aforementioned Item [17], the same effects as mentioned above can be obtained.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF DRAWINGS

The preferred embodiments of the present invention are shown by way of example, and not limitation, in the accompanying figures, in which.

DESCRIPTION OF REFERENCE NUMERALS

Figure 1:
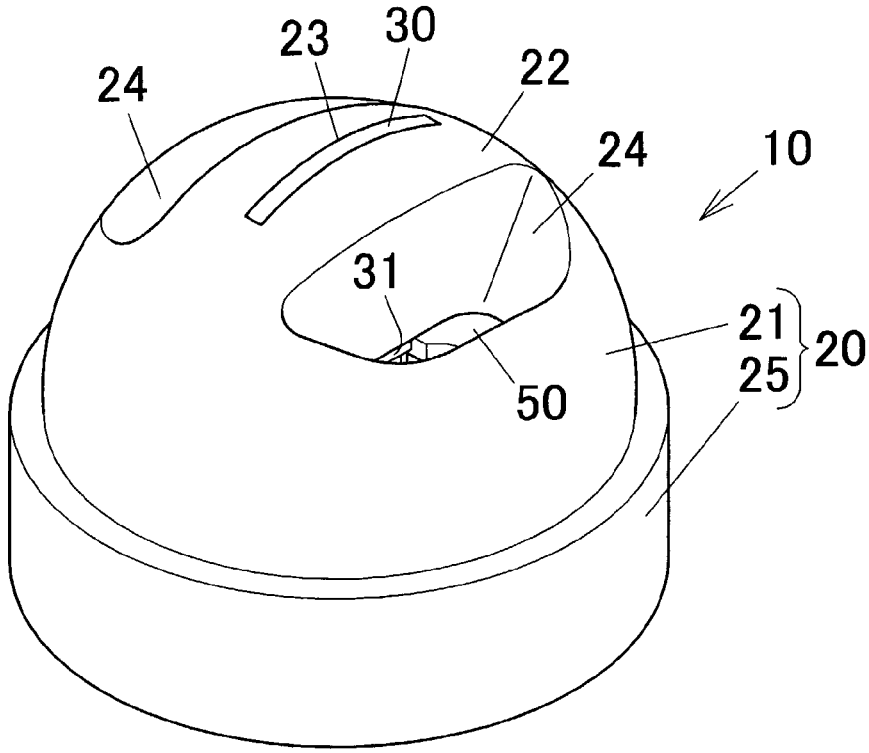
FIG. 1 is a perspective view of an extrusion die according to an embodiment of the present invention.
Figure 2:
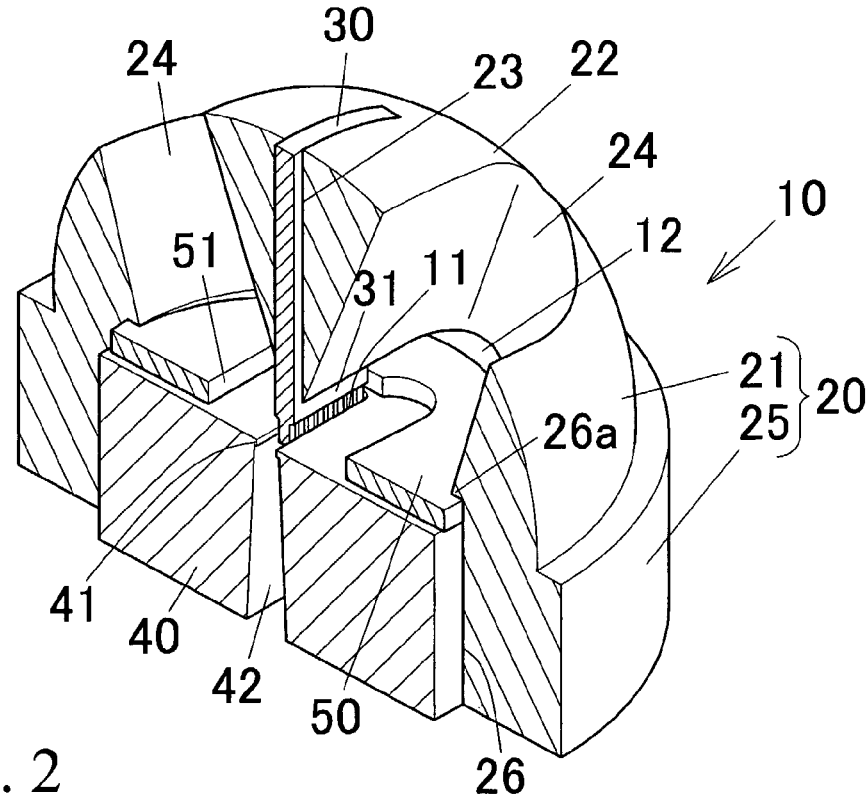
FIG. 2 is a perspective cutout view of the extrusion die according to the embodiment.

6 . . . Container
10 . . . Extrusion die
11 . . . Extrusion hole
20 . . . Die holding case

21 . . . Dome portion
22 . . . Billet pressure receiving surface (metallic material pressure receiving surface)
24 . . . Porthole
25 . . . Base portion
30 . . . Male die
31 . . . Mandrel
33 . . . Passage forming protruded portion
40 . . . Female die
41 . . . Die hole
60 . . . Hollow member
63 . . . Passage
A1 . . . Axial center of die holding case (dome portion)
A2 . . . Axial center of porthole
θ . . . Inclination angle

BEST MODE FOR CARRYING OUT THE INVENTION

In the following paragraphs, some preferred embodiments of the invention will be described by way of example and not limitation. It should be understood based on this disclosure that various other modifications can be made by those in the art based on these illustrated embodiments.

Figure 10:
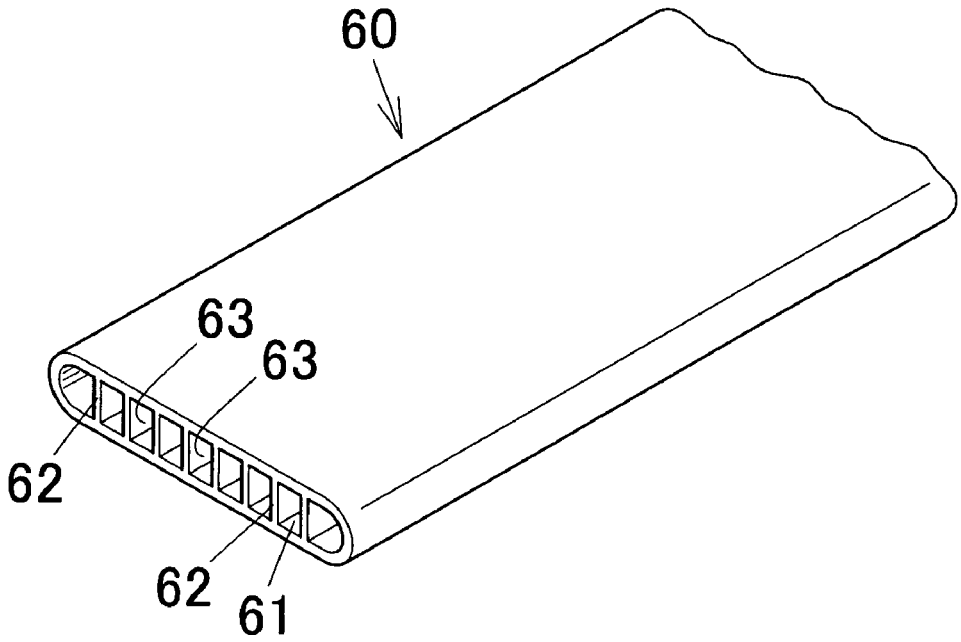
FIG. 10 is a perspective view showing a multi-bored hollow member extruded with an extruder according to an embodiment.
Figure 11:
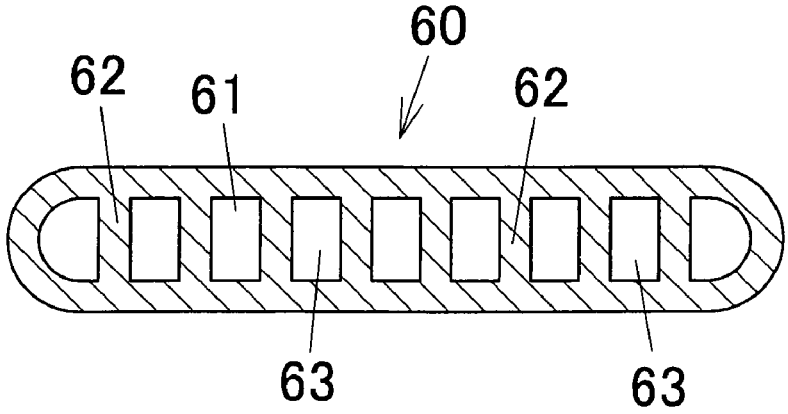
FIG. 11 is a front cross-sectional view showing the multi-bored hollow member extruded with the extruder of the embodiment.

FIGS. 1 to 6 show an extrusion die 10 for metallic material according to an embodiment of this invention. As shown in these drawings, this extrusion die 10 is configured to extrude a hollow member 60 shown in FIGS. 10 and 11.

The hollow member 60 is a metal member, which concretely constitutes an aluminum or aluminum alloy heat exchanging tube 60 in this embodiment.

This hollow member 60 is a member for use in a heat exchanger, such as, e.g., a condenser for car air-conditioners, and has a flat configuration. The hollow portion 61 of the hollow member 60 is extended in the tube length direction and divided into a plurality of heat exchanging passages 63 by a plurality of partitions 62 arranged in parallel with each other. These passages 63 are extended in the tube length direction and arranged in parallel with each other.

In the following explanation of this embodiment, a direction with which a tube length direction perpendicularly intersects and along which the passages 63 are arranged will be referred to as a "width direction," and a direction with which a tube length direction perpendicularly intersects and with which a width direction perpendicularly intersects will be referred to as a "height direction (thickness direction)." Furthermore, in this embodiment, the "upstream side" of the extrusion direction will be referred to as a "rear side", and the "downstream side" thereof will be referred to as a "front side."

The hollow member 60 to be extruded using the extrusion die 10 of the present invention is not limited to a member used as a heat exchanging tube 60 for heat exchangers, and can be used for any other application. The cross-sectional configuration is not specifically limited.

As shown in FIGS. 1 to 6, the extrusion die 10 of this embodiment is equipped with a die holding case 20, a male die 30, a female die 40, and a flow control plate 50, as fundamental elements.

The die holding case 20 has a hollow structure, and has a dome portion 21 provided at the upstream (rear side) with respect to the extrusion direction of a metal billet as metallic material and a base portion 25 provided at the downstream (front side) with respect to the extrusion direction.

In the dome portion 21, the surface (rear surface) thereof opposed to the extrusion direction of the metal billet is formed as a billet pressure receiving surface 22 as a metallic material pressure receiving surface. This billet pressure receiving surface 22 is formed into a convex configuration protruded in the direction (rear direction) opposed to the extrusion direction, more specifically, formed into a convex hemisphere configuration.

At the center of the periphery of the dome portion 21, the male die holding slit 23 communicated with the internal hollow portion (welding chamber 12) is formed along the axial center A1 of the dome portion 21. This male die holding slit 23 is formed into a flat rectangular cross-sectional configuration corresponding to the cross-sectional configuration of the male die 30. Furthermore, at both rear end sides of the male die holding slit 23, engaging stepped portions 23*a* and 23*a* for engaging the male die 30, which will be mentioned later, is formed.

At both sides of the peripheral wall of the dome portion 21, a pair of portholes 24 and 24 are formed across the axial center A1 of the dome portion 21. Each porthole 24 has an elongated cross-sectional shape extending along the peripheral direction of the dome portion 21 and arranged at regular intervals in the peripheral direction. Furthermore, each porthole 24 is formed such that the axial center A2 of the porthole 24 approaches the axial center A14 of the dome portion 21 as it advances toward the downstream side (front side) and intersects with the axial center A1 of the dome portion 21 in an inclined state. The detail structure, such as, e.g., the inclination angle θ of the porthole 24, will be detailed later.

In this embodiment, it is configured that the central axis of the die holding case 20 and the central axis A1 of the dome portion 21 coincides with each other.

The base portion 25 is integrally formed to the dome portion 21 with the peripheral surface of the base portion 25 radially outwardly protruded from the peripheral surface of the basal end portion of the dome portion 21.

In the base portion 25, a cylindrical female die holding hole 26 having a cross-sectional configuration corresponding to the cross-sectional configuration of the female die 40 is formed so as to be communicated with an internal welding chamber 12. The central axis of this female die holding hole 26 is constituted so as to coincide with the central axis A1 of the die holding case 20.

Figure 3:
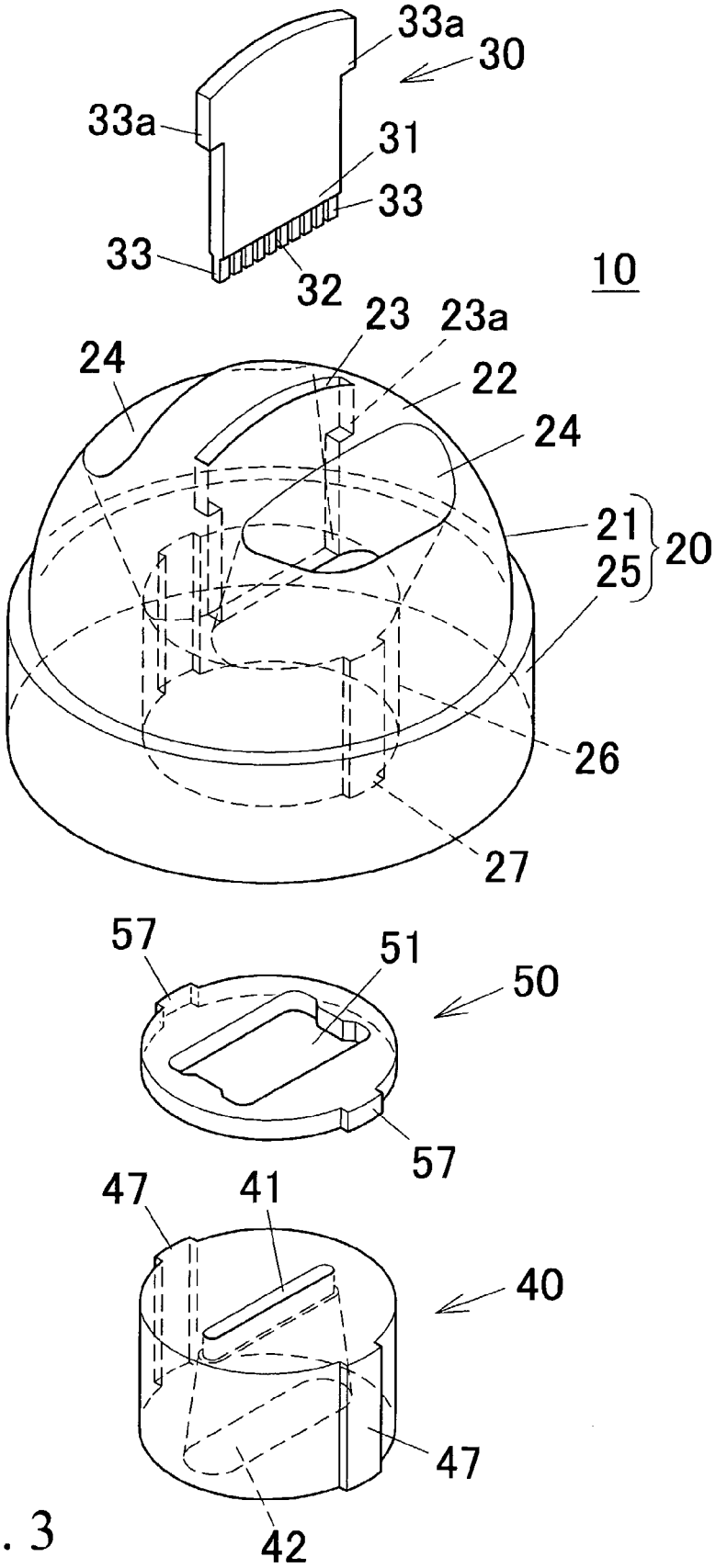
FIG. 3 is an exploded perspective view of the extrusion die according to the embodiment.
Figure 4:
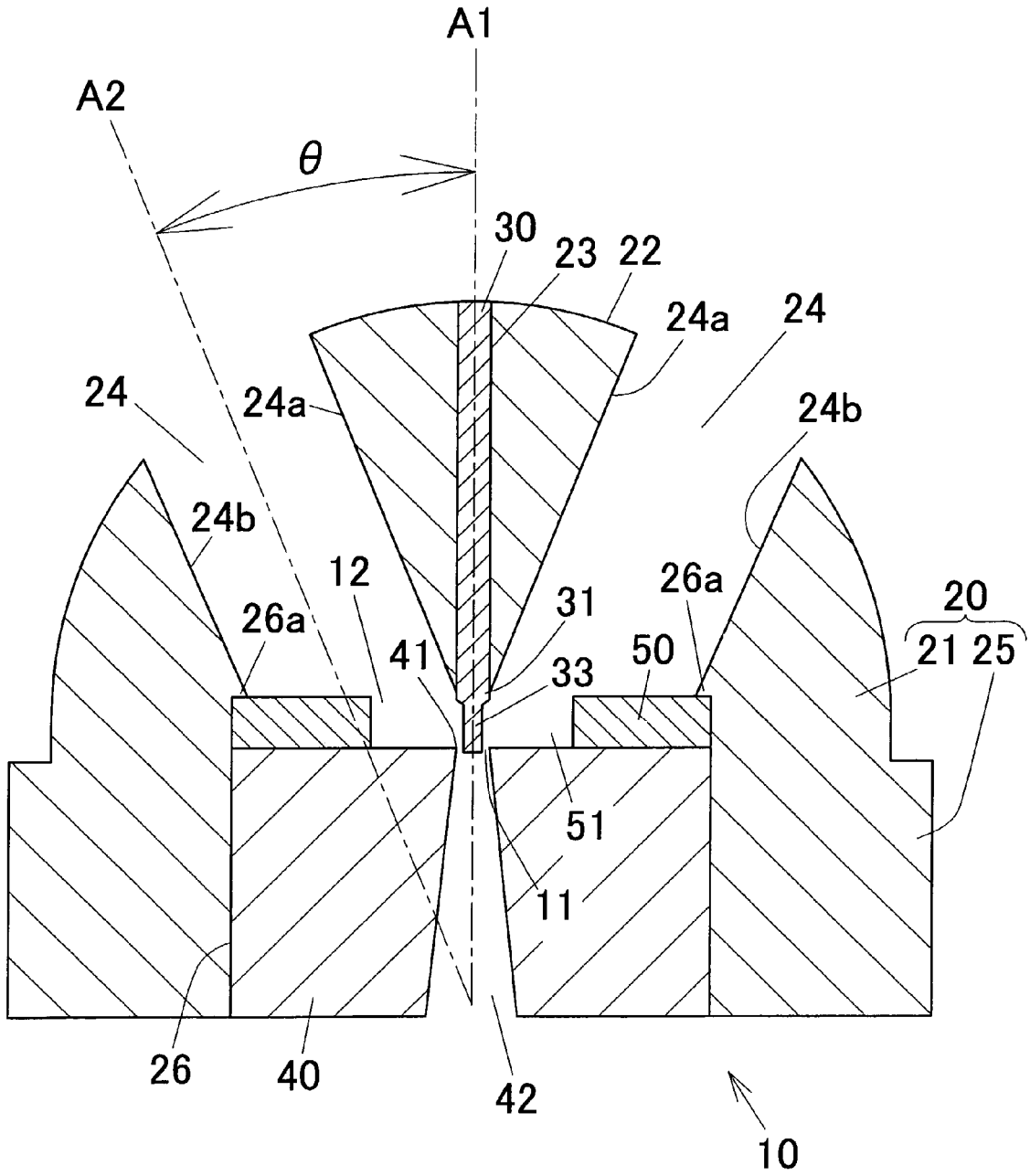
FIG. 4 is an enlarged cross-sectional view of the extrusion die according to the embodiment.

As shown in FIG. 4, etc., at the rear end side in the inner peripheral surface of the female die holding hole 26, an engaging stepped portion 26*a* for engaging the female die 40 via the flow control plate 50 is formed. Furthermore, as shown in FIG. 3, opposed keyways 27 and 27 parallel to the central axis A1 are formed on the inner peripheral surface of the female die holding hole 26.

Figure 5:
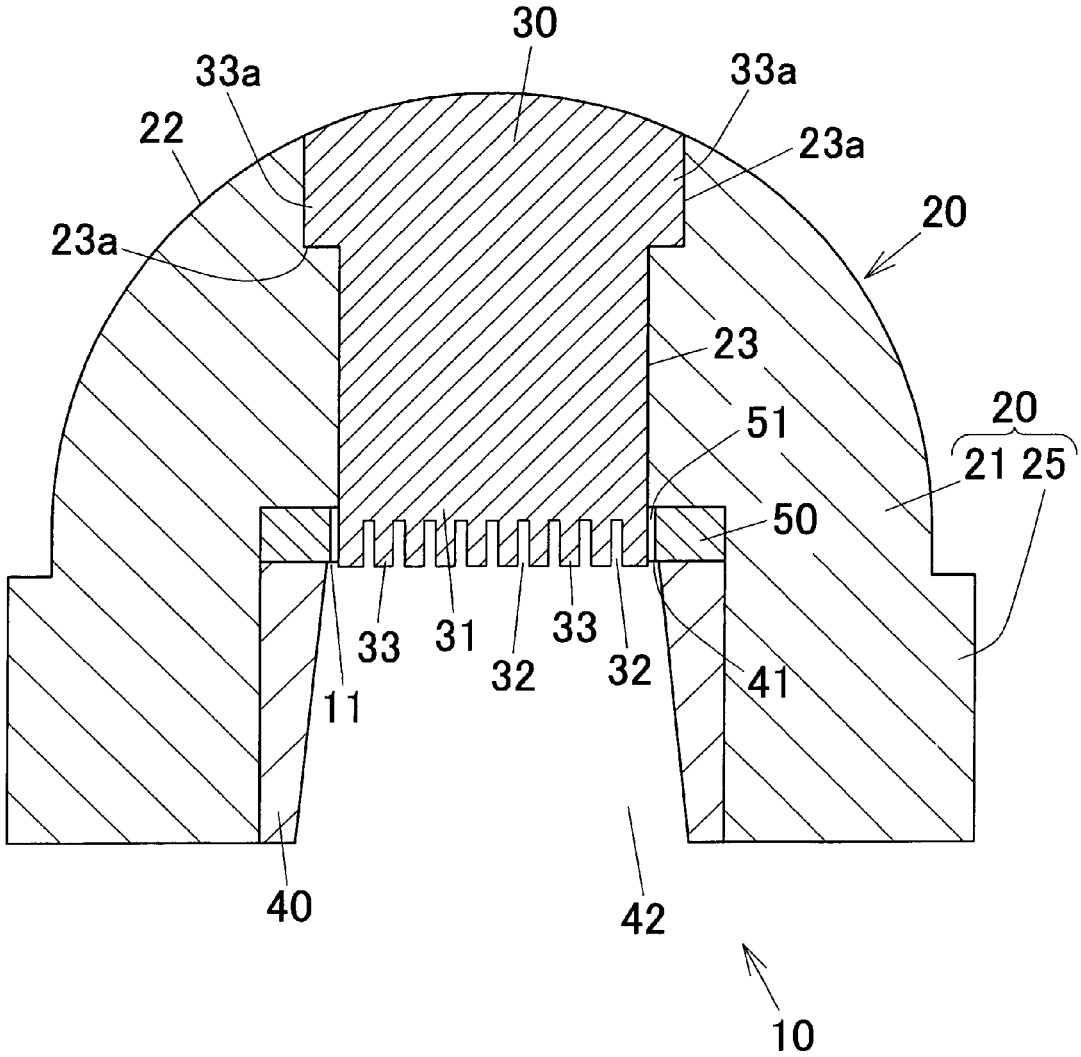
FIG. 5 is another enlarged cross-sectional view of the extrusion die according to the embodiment.
Figure 6:
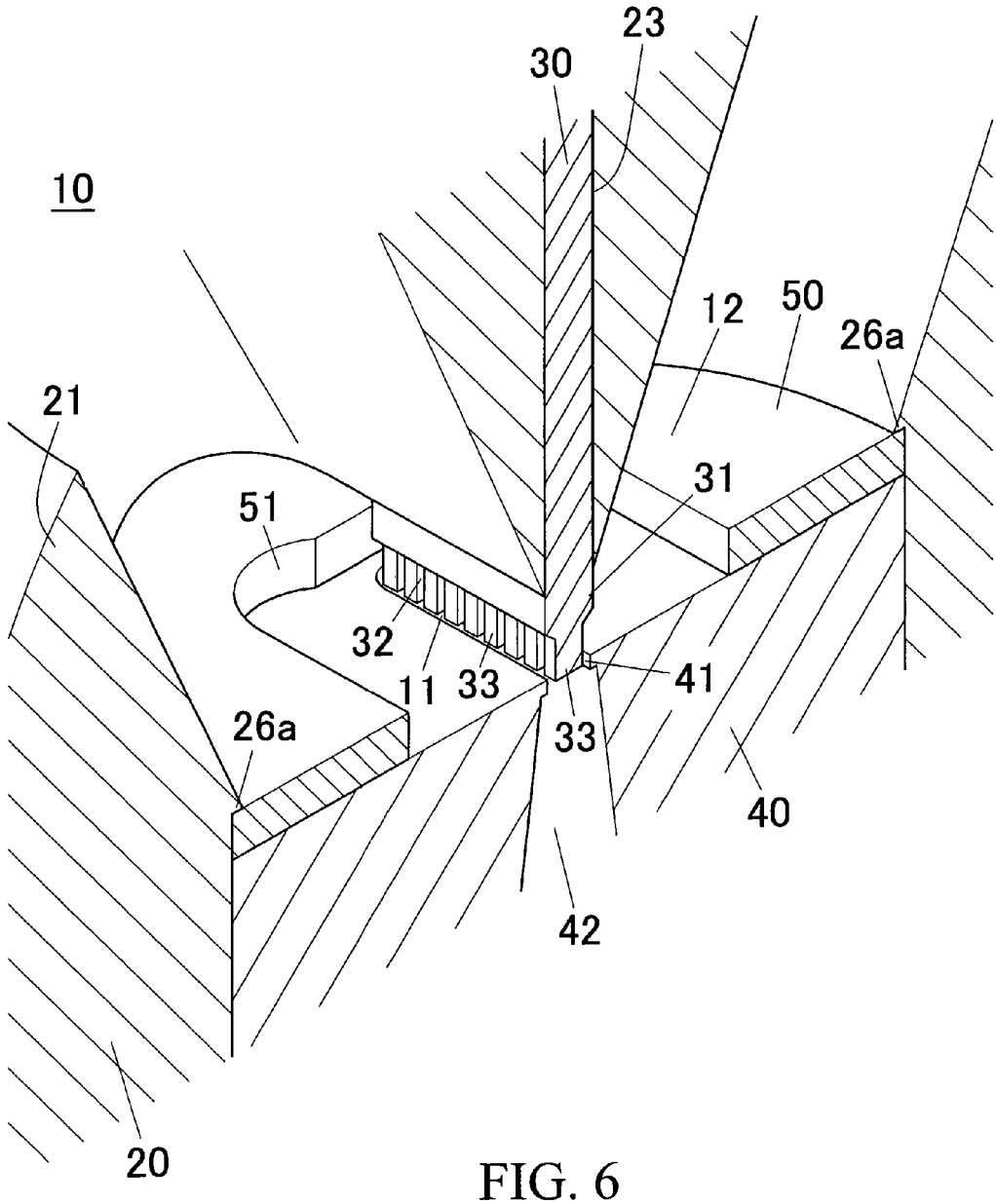
FIG. 6 is an enlarged cutout perspective view showing the inside of the extrusion die according to the embodiment.

In the male die 30, the front end principal part constitutes a mandrel 31. As shown in FIGS. 5 and 6, the front end portion of the mandrel 31 is configured to form the hollow portion 61 of the hollow member 60, and provided with a plurality of passage forming protrusions 33 each corresponding to each passage 63 of the hollow member 60. These passage forming protrusions 33 are arranged at certain intervals in the width direction of the mandrel 31. Furthermore, the gap formed between the adjacent passage forming protrusions 33 constitutes a partition forming groove 32 for forming the partition 62 of the hollow member 60.

At the widthwise side edges of the rear end portion of the male die 30, engaging protrusions 33*a* and 33*a* corresponding to the aforementioned engaging stepped portions 23*a* and 23*a* of the male die holding slit 23 formed in the die holding case 20 are integrally provided in such a manner that the engaging protrusions 33*a* and 33*a* protrude sideways.

This male die 30 is inserted into the male die holding slit 23 of the aforementioned die holding case 20 from the side of the billet pressure receiving surface 22 and fixed therein. In this state, the engaging protrusions 33*a* and 33*a* of the male die 30 are engaged with the engaging stepped portions 23*a* and 23*a* in the male die holding slit 23 to be positioned. Thus, the mandrel 31 of the male die 30 is held in a state in which the mandrel 31 of the male die 30 is forwardly protruded from the male die holding slit 23 by a predetermined amount.

The basal end face (rear end face) of the male die 30 is formed so as to constitute a part of the spherical surface forming the billet pressure receiving surface 22 of the die holding case 20, so that the basal end face (rear end face) of the male die 30 and the billet pressure receiving surface 22 form a prescribed smooth convex spherical surface.

As shown in FIG. 3, the female die 40 is cylindrical in configuration, and has, at its both sides of the peripheral surface, key protrusions 47 and 47 parallel to the central axis and corresponding to the keyways 27 and 27 of the female die holding hole 26 in the die holding case 20.

The female die 40 is provided with a die hole (bearing hole 41) opened to the rear end face side and formed corresponding to the mandrel 31 of the male die 30, and a relief hole 42 communicated with the die hole 41 and opened to the front end face side.

The die hole 41 is provided with an inwardly protruded portion along the inner peripheral edge portion so that the outer peripheral portion of the hollow member 60 can be defined. The relief hole 42 is formed into a tapered shape gradually increasing the thickness (height) toward the front end side (downstream side) and opened at the downstream side.

The flow control plate 50 is formed into around shape in external periphery corresponding to the cross-sectional shape of the female die holding hole 26 of the die holding case 20. Corresponding to the mandrel 31 of the male die 30 and the die hole 41 of the female die 40, a central through-hole 51 is formed in the center of the flow control plate 50.

As shown in FIG. 3, the flow control plate 50 has, at its both sides of the external peripheral edge portion, key protrusions 57 and 57 corresponding to the keyways 27 and 27 of the female die holding hole 26 in the die holding case 20.

The aforementioned female die 40 is fitted in and fixed to the female die holding hole 26 of the die holding case 20 via the flow control plate 50. In this state, the outer periphery of the end face (rear end face) of the female die 40 is engaging with the engaging stepped portion 26*a* of the female die holding hole 26 via the peripheral portion of the flow control plate 50, so that the female die 40 and the flow control plate 50 are positioned in the axial direction (i.e., in the extrusion direction). Furthermore, the key protrusions 47 and 47 of the female die 40 and the key protrusions 57 and 57 of the flow control plate 50 are engaged with the keyways 27 and 27 of the female die holding hole 26, so that they are positioned in the peripheral direction about the central axis A1.

With this, the mandrel 31 of the male die 30 and the die hole 41 of the female die 40 are arranged at a position corresponding to the center of the through-hole 51 of the flow control plate 50. At this time, the mandrel 31 of the male die 30 is positioned in the die hole 41 of the female die 40 to define a flat circular extrusion hole 11 by and between the mandrel 31 and the die hole 41. Furthermore, in this extrusion hole 11, a plurality of partition forming grooves 32 of the mandrel 31 are arranged in parallel each other along the width direction, and therefore the extrusion hole 11 has a cross-sectional shape corresponding to the cross-sectional shape of the hollow member 60 to be formed.

Now, the detailed structure of the porthole 24 of the die holding case 20 of this embodiment will be explained. A pair of upper and lower portholes 24 and 24 are arranged at positions corresponding to both sides of the height direction (thickness direction) of the extrusion hole 11, and the outlet end portion (front end portion) of the pair of portholes 24 and 24 are arranged corresponding to the extrusion hole 11.

As explained earlier, the portholes 24 and 24 are set so that the central axis A2 inclines to the central axis A1 of the die holding case 20. As shown in FIG. 4, in this embodiment, the inclination angle θ of the central axis A2 of the porthole 24 to the central axis A1 of the die holding case 20 is preferably set to 10° to 35° more preferably 15° to 30°. When the inclination angle θ is set within the aforementioned specific ranges, the metallic material can stably flow through the portholes 24 and 24 and the welding chamber 12, resulting in a smooth flow through the extrusion hole 11 in a well balanced manner along the entire periphery thereof, which in turn makes it possible to extrude a high quality extruded article excellent in dimensional accuracy. In other words, if the aforementioned inclination angle θ is too small, the metallic material passed through the portholes 24 and 24 and the welding chamber 12 would not be smoothly introduced into the extrusion hole 11, which may cause a difficulty in stably obtaining a high quality extruded article. Therefore, it is not preferable. To the contrary, if the inclination angle θ is too large, the material flowing direction of the porthole 24 inclines excessively with respect to the material extrusion direction, resulting in a large extrusion load of metallic material. Therefore, it is also not preferable.

In this embodiment, it is preferable that the billet pressure receiving surface 22 of the die holding case 20 has a configuration constituted by a convex spherical surface of a ⅙ sphere to a ⅘ sphere. In other words, when the billet pressure receiving surface 22 is formed into the aforementioned specific configuration, the pressing force of a metal billet can be received by the billet pressure receiving surface 22 in a deconcentrated manner, resulting in sufficient strength, which in turn can extend the die life. In addition to the above, it also makes it possible to simplify the die configuration, reduce the size and weight, and also reduce the cost. In other words, if the billet pressure receiving surface is formed into a configuration constituted by a convex spherical surface of a sphere smaller than a ⅙ sphere, such as, e.g., a convex spherical surface constituted by a ⅛ sphere, sufficient strength against the billet pressing force cannot be obtained, which may cause deteriorated die life due to the generation of cracks. To the contrary, if the billet pressure receiving surface is formed into a configuration constituted by a convex spherical surface of a sphere exceeding a ⅘ sphere, such as, e.g., a convex spherical surface configuration of a ⅚ sphere, the cost may be increased due to the complicated configuration.

In this embodiment, the sphere with a ratio, such as, e.g., a ⅛ sphere, a ⅙ sphere, or a ⅘ sphere, is defined by a partial sphere obtained by cutting a perfect sphere with a plane perpendicular to the central axis of the perfect sphere. That is, in this embodiment, an "n/m sphere ("m" and "n" are natural numbers, and n<m)" is defined by a partial sphere obtained by cutting a perfect sphere with a plane perpendicular to the central axis of the perfect sphere at a position where a distance from a surface of the perfect sphere to an inner position of the perfect sphere on the central axis (diameter) is n/m where the length of the central axis (diameter) of the perfect sphere is "1."

As shown in FIG. 4, in this embodiment, the inner side surface 24*a* and the outer side surface 24*b* among the inner periphery of the porthole 24 are arranged approximately in parallel with each other and also approximately in parallel to the central axis A2 of the porthole 24. Furthermore, the inner side surface 24*a* and the outer side surface 24*b* of the porthole inner periphery are constituted as an inclined surface (tapered surface) inclined to the central axis A1 of the die holding case 20, respectively.

Figure 7:
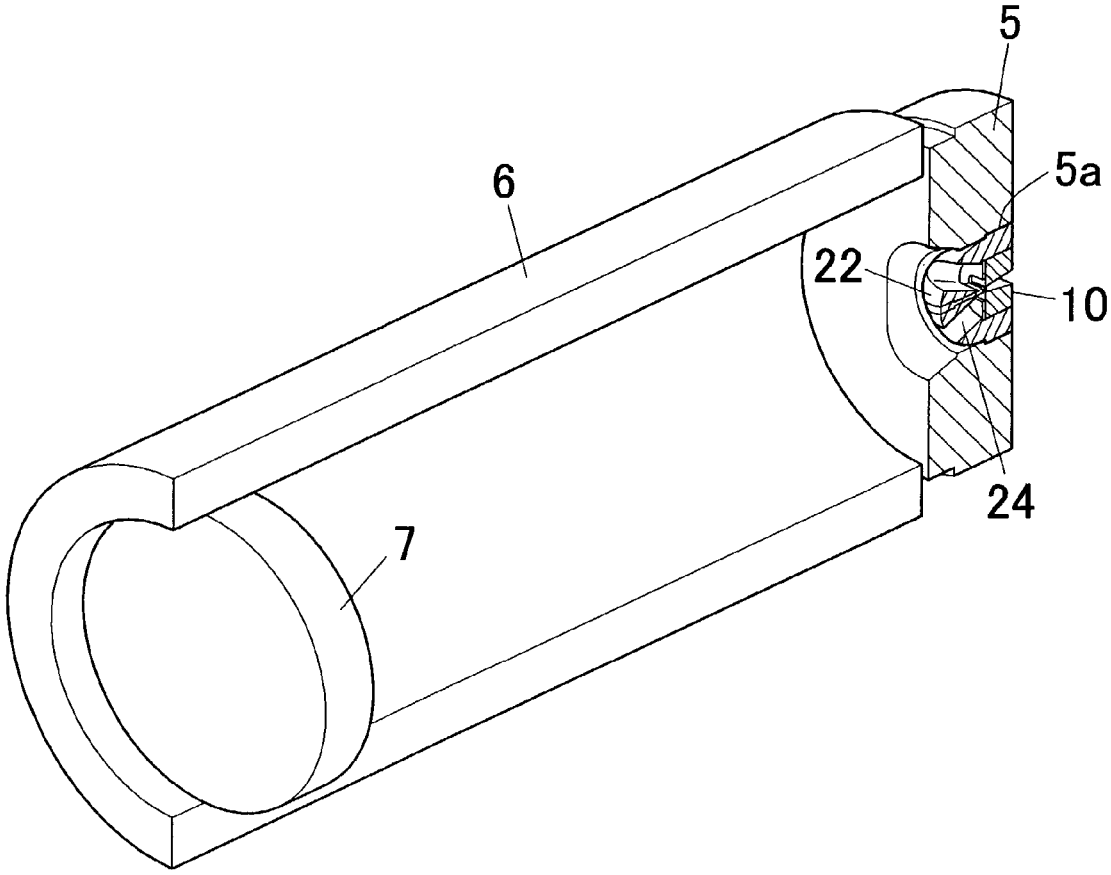
FIG. 7 is a perspective cutout view showing a principal portion of an extruder to which the extrusion die of the embodiment is applied.
Figure 8:
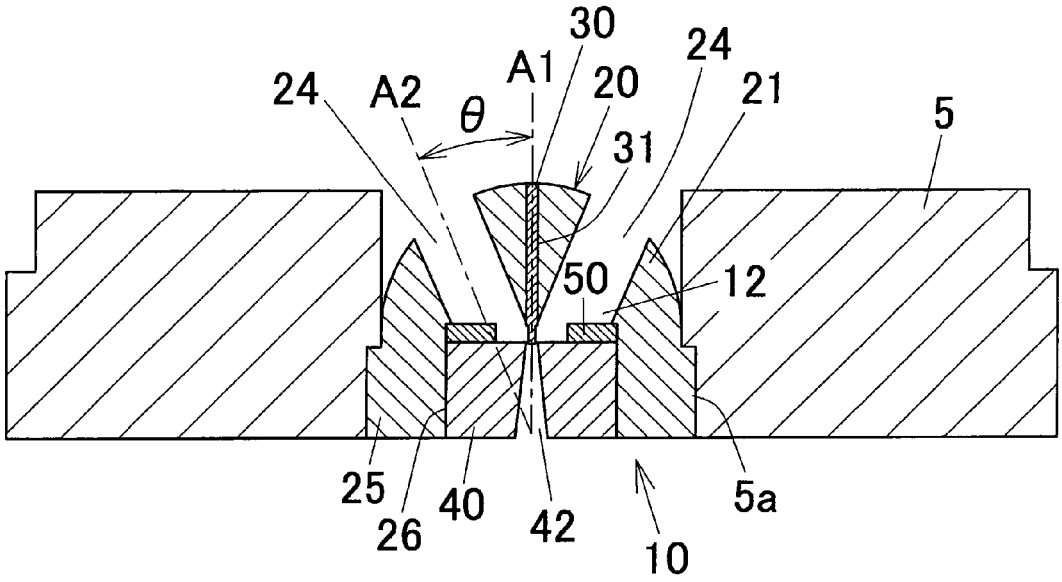
FIG. 8 is a cross-sectional view showing the extrusion die of the embodiment and its vicinity in an extruder.
Figure 9:
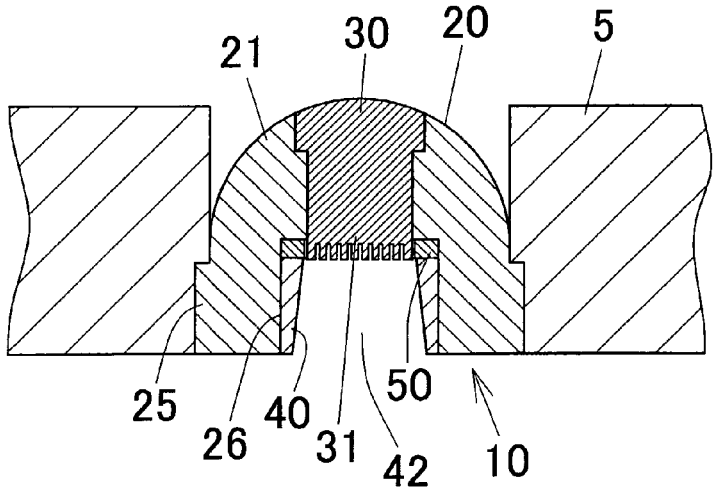
FIG. 9 shows another cross-sectional view showing the extrusion die of the embodiment and its vicinity in the extruder.

The extrusion die 10 having the aforementioned structure is set in an extruder as shown in FIGS. 7 to 9. That is, the extrusion die 10 of this embodiment is set to a container 6 with the extrusion die 10 fixed in the die installation hole 5*a* formed in the center of a plate 5. The extrusion die 10 is fixed by the plate 5 in a direction perpendicular to the extrusion direction and also fixed by a backer (not illustrated) in the extrusion direction.

A metal billet (metallic material), such as, e.g., an aluminum billet, inserted in the container 6 is pressed in the right direction (extrusion direction) in FIG. 7 via a dummy block 7. Thereby, the metal billet is pressed against the billet pressure receiving surface 22 of the die holding case 20 constituting the extrusion die 10 to be plastically deformed. As a result, the metallic material passes through the pair of portholes 24 and 24 while being plastically deformed and then reaches the welding chamber 12 of the die holding case 20. Then, the material is forwardly extruded through the extrusion hole 11 into a cross-sectional configuration corresponding to the opening configuration of the extrusion hole 11. Thus, a metal extruded article (hollow member 60) is manufactured.

In this extruding, according to the extrusion die 10 of this embodiment, since the billet pressure receiving surface 22 is formed into a convex spherical configuration, when the metal billet is pressed against the billet pressure receiving surface 22, the pressing force can be received by the convex spherical surface in a deconcentrated manner. Therefore, the pressing force to be applied to each portion of the billet pressure receiving surface 22 in the direction of a normal line can be reduced, thereby increasing the strength against the pressing force of the metallic material, which results in sufficient durability.

In this embodiment, the portholes 24 for introducing material are formed in the dome portion 21 of the die holding case 20 covering the male die 30 and the female die 40, i.e., the front end wall portion of the dome portion 21 and the wall portion of the base portion 25 are formed integrally and continuously in the peripheral direction. The existence of this continued peripheral wall portion can markedly increase the strength of the die holding case 20, which in turn can further increase the entire strength of the extrusion die. Accordingly, a portion weak in strength, such as, e.g., a conventional bridge portion, does not exist, and therefore it is not required to unnecessarily increase a size, such as, e.g., a thickness, to improve the strength, which makes it possible to attain the reduced size and weight as well as the cost reduction.

Furthermore, in this embodiment, the portholes 24 and 24 are formed at positions away from the central axis A1 of the dome portion 21, i.e., at the periphery of the dome portion 21, and the central axis A2 of each porthole 24 is inclined to the central axis A1 of the die holding case 20 so as to gradually approach the central axis A1 of the die holding case 20 toward the downstream side. Therefore, the metallic material passing through the portholes 24 and 24 can be stably extruded while being smoothly introduced to the axial center A1, i.e., the extrusion hole 11. Furthermore, in this embodiment, since the downstream end portions (outlets) of the portholes 24 and 24 are faced toward the extrusion hole 11, the metallic material can be more smoothly introduced to the extrusion hole 11.

Furthermore, in this embodiment, since the portholes 24 and 24 are arranged at both sides of the height direction (thickness direction) of the flat extrusion hole 11, the metallic material can be more smoothly introduced into the extrusion hole 11 in a stable manner. Accordingly, the metallic material is made to evenly pass through the entire area of the extrusion hole 11 in a well-balanced manner, to thereby obtain a high quality extruded hollow member 60.

Especially like in this embodiment, even in the case of obtaining a hollow member 60 having a complicated configuration, such as, e.g., a flat harmonica tube configuration, metallic material can be introduced into the entire region of the extrusion hole 11 in a well-balanced manner, which enables to assuredly maintain the high quality.

For reference, in cases where an aluminum heat exchanging tube (hollow member) provided with a plurality of passages 63 each rectangular in cross-section having a height of 0.5 mm and a width of 0.5 mm, in a conventional extrusion die, since the strength was not sufficient, cracks generated in the male die caused a shortened die life. On the other hand, in the extrusion die 10 according to the present invention, since the strength is sufficient, no crack was generated in the male die 30. Therefore, the wear of the male die 30 becomes a factor of the die life, which can remarkably improve the die life.

For example, according to the results of experiments relevant to a die life performed by the present inventors, in the extrusion die according to the present invention, the length of die life was extended about three times as compared with a conventional one.

Moreover, in the present invention, since it has sufficient pressure resistance (strength), the extrusion limit speed can be raised considerably. For example, in a conventional extrusion die, the maximum extrusion speed was 60 m/min. On the other hand, in the extrusion die according to the present invention, the maximum extrusion speed can be raised up to 150 m/min, i.e., the extrusion limit speed can be raised about 2.5 times, and therefore the improvement in productive efficiency can be further expected.

Figure 12:
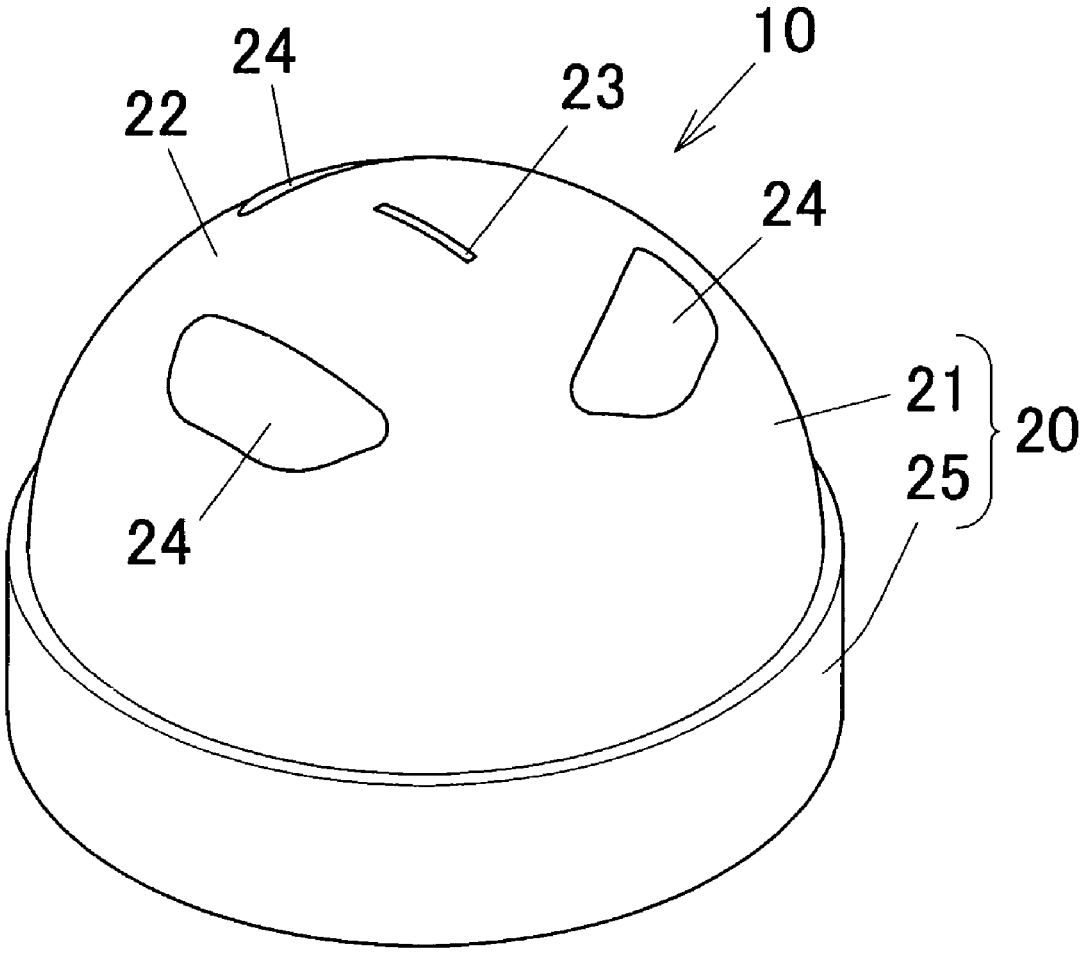
FIG. 12 is a perspective view showing a die holding case of an extrusion die according to a first modification of the invention.
Figure 13:
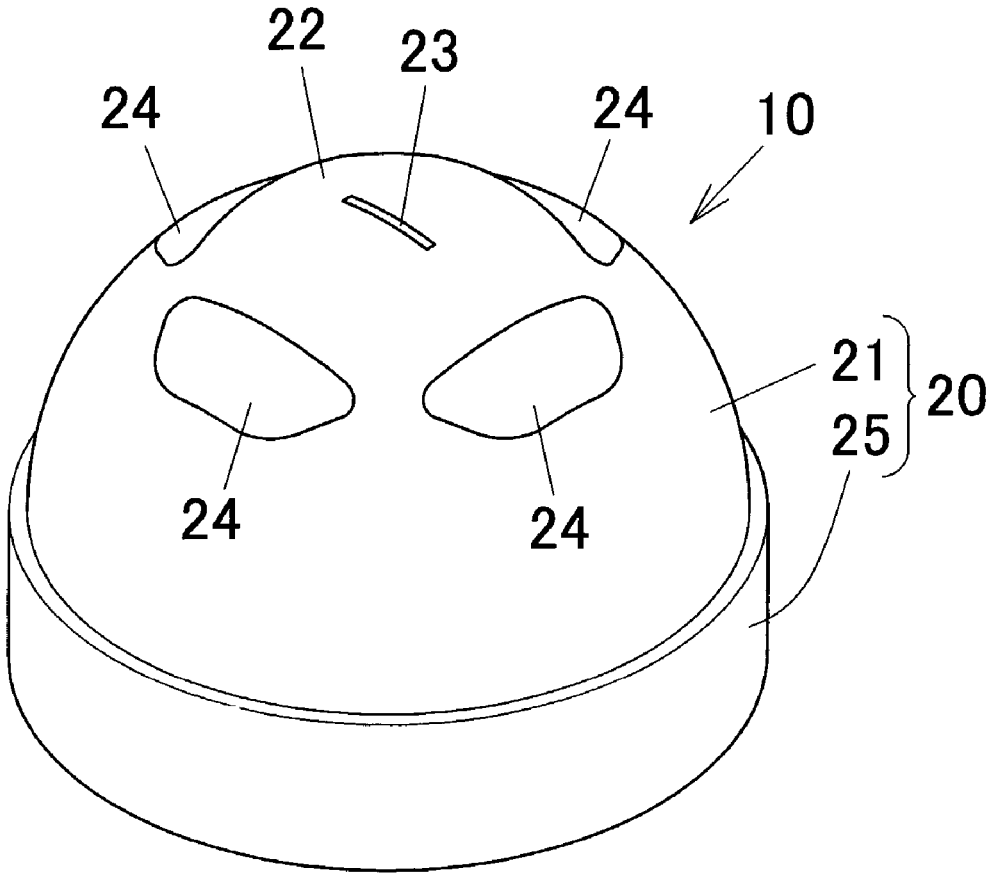
FIG. 13 is a perspective view showing a die holding case of an extrusion die according to a second modification of the invention.

In the aforementioned embodiment, the explanation was addressed to the case in which two portholes 24 were provided. It should be noted, however, that the present invention is not limited to it and allows a case in which three portholes 24 are provided as shown in FIG. 12, a case in which four portholes 24 are provided as shown in FIG. 13, or a case in which one porthole 24 or five or more portholes 24 are provided.

Figure 14:
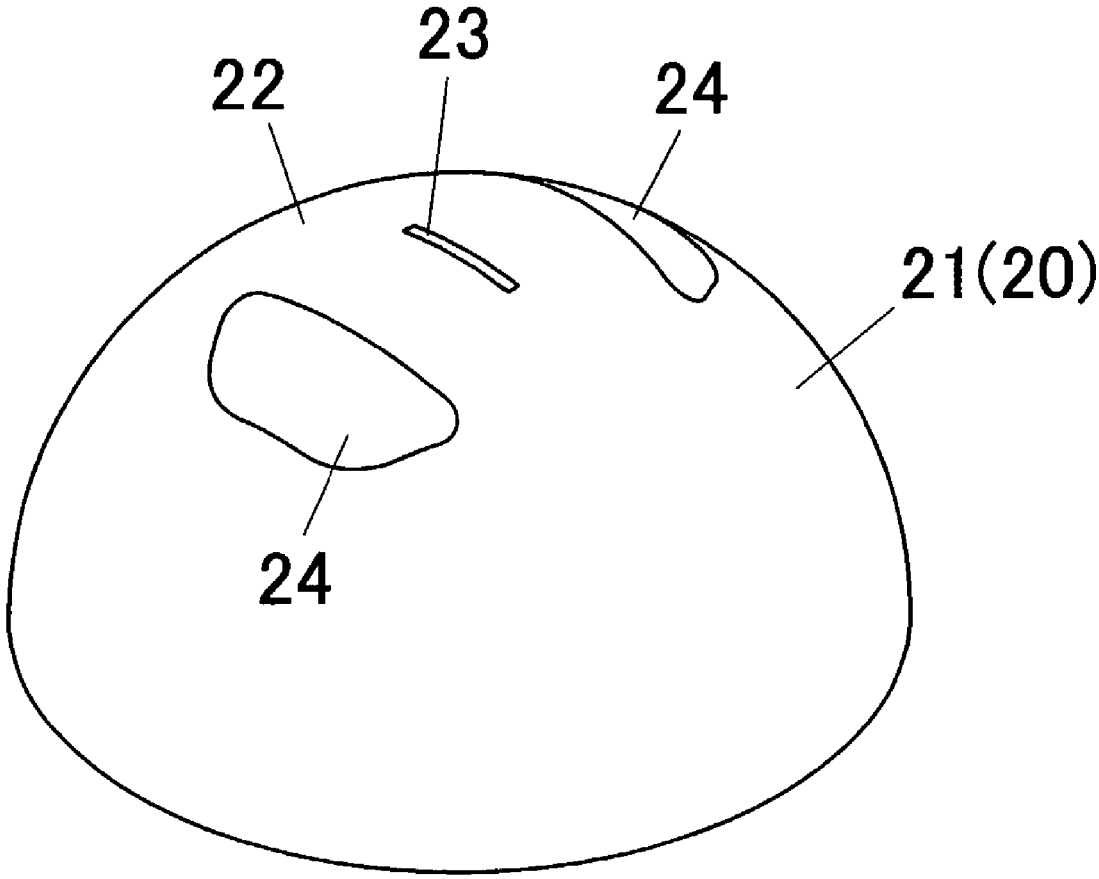
FIG. 14 is a perspective view showing a die holding case of an extrusion die according to a third modification of the invention.
Figure 15:
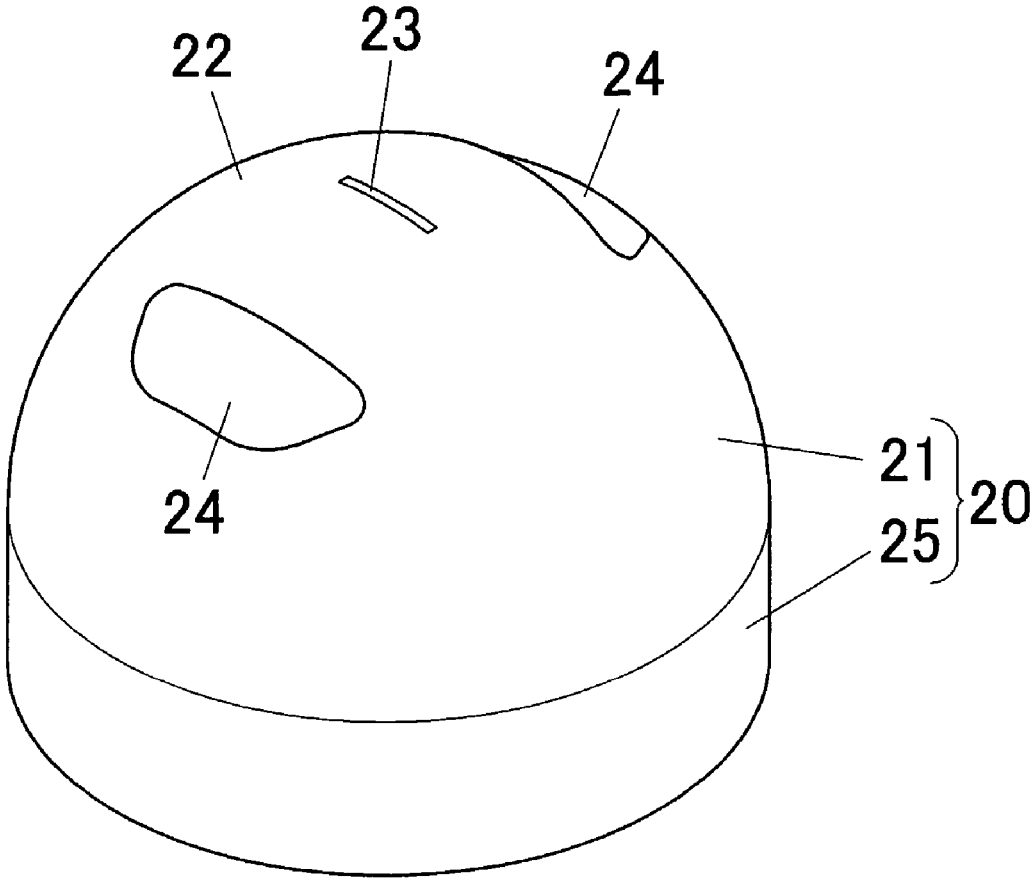
FIG. 15 is a perspective view showing a die holding case of an extrusion die according to a fourth modification of the invention.
Figure 16A:
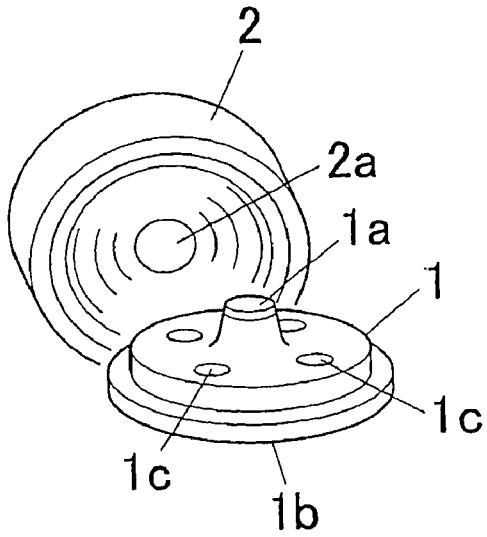
FIG. 16A PRIOR ART
FIG. 16A is an exploded perspective view showing a conventional porthole die.
Figure 16B:
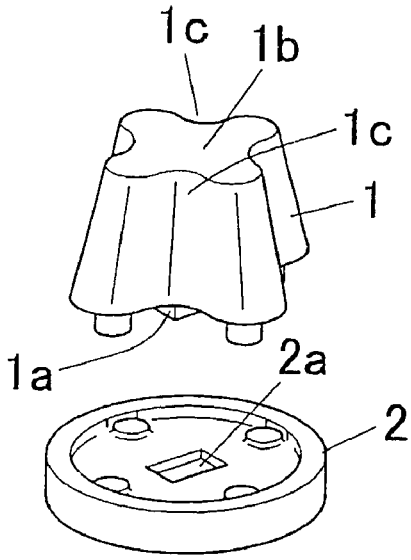
FIG. 16B PRIOR ART
FIG. 16B is an exploded perspective view showing a conventional spider die.
Figure 16C:
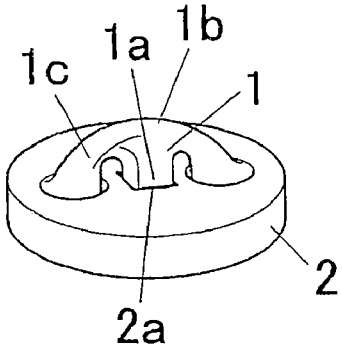
FIG. 16C PRIOR ART
FIG. 16C is a perspective view showing a conventional bridge die.

Furthermore, in the aforementioned embodiment, the explanation was addressed to the case in which the base portion 25 is formed at the front end portion of the die holding case 20. It should be noted, however, that the present invention is not limited to the above. For example, the present invention can be applied to the case in which no base portion is provided at the front end portion of the die holding case 20 as shown in FIG. 14 or the case in which a base portion 25 of the die holding case 20 is formed so that the external peripheral surface of the base portion 25 is flush with the front end external peripheral surface of the dome portion 21 as shown in FIG. 15.

Furthermore, in the aforementioned embodiment, although the case in which a single extrusion die is set to a container is exemplified, the present invention is not limited to it. In the present invention, it can be constituted such that two or more extrusion dies can be set to a container.

Moreover, in the aforementioned embodiment, although the case in which the male die and the female die are formed separate from the die holding case was exemplified, the present invention is not limited to it. For example, in the present invention, it can be configured such that a male die and/or a female die is integrally formed to a die holding case (die case).

EXAMPLE

TABLE 1

| | Inclination angle of porthole (θ) | Die life (Ton/die) | Life limiting factor | Extrusion load ($\times 10^4$N) |
|---|---|---|---|---|
| Example 1 | 8° | 2.0 | Generation of cracks in male die | 1,400 |
| Example 2 | 10° | 3.0 | Wear of male die | 1,450 |
| Example 3 | 20° | 3.0 | Wear of male die | 1,500 |
| Example 4 | 30° | 3.0 | Wear of male die | 1,600 |
| Example 5 | 35° | 3.0 | Wear of male die | 1,700 |
| Example 6 | 38° | 3.0 | Wear of male die | 1,800 |
| Comparative Example | — | 0.7 | Generation of cracks in male die | 1,500 |

Example 1

As shown in Table 1, in accordance with the aforementioned embodiment, an extrusion die having two portholes 24 and 24 and an 8° inclination angle θ of the central axis A2 of the porthole 24 to the central axis A1 was prepared.

In this extrusion die, the billet pressure receiving surface 22 was constituted by an external periphery of a ½ sphere of radius 30 mm. As a male die 30, a male die in which the height (thickness) of the mandrel 31 was 2.0 mm, the width of the mandrel 31 was 19.2 mm, the height of the passage forming protrusion 33 was 1.2 mm, the width of the passage forming protrusion 33 was 0.6 mm, and the width of the partition forming groove 32 was 0.2 mm was used. Furthermore, as a female die 40, a female die in which the height (thickness) of the die hole 41 was 1.7 mm, and the width of the die hole 41 was 20.0 mm was used. This extrusion die 10 was set to an extruder similar to the aforementioned embodiment as shown in FIGS. 7 to 9, an extrusion molding was executed to manufacture a hollow member (heat exchanging tube 60) having a cross-sectional configuration corresponding to the extrusion hole 11 formed between the male die 30 and the female die 40.

Then, the extrusion load N at the time of manufacturing and the die life (the amount of introduced material (ton/die) until cracks and/or wear of the die was generated were measured, and the die life limiting factor was investigated. The results are shown in Table 1.

Example 2

As shown in Table 1, an extrusion die 10 was prepared in the same manner as in Example 1 except that the inclination angle θ of the porthole 24 was set to 10°, Then, the extrusion die 10 was set to the same extruder as in Example 1, and the same process as in Example 1 was executed.

Example 3

As shown in Table 1, an extrusion die 10 was prepared in the same manner as in Example 1 except that the inclination angle θ of the porthole 24 was set to 20°, Then, the extrusion die 10 was set to the same extruder as in Example 1, and the same process as in Example 1 was executed.

Example 4

As shown in Table 1, an extrusion die 10 was prepared in the same manner as in Example 1 except that the inclination angle θ of the porthole 24 was set to 30°, Then, the extrusion die 10 was set to the same extruder as in Example 1, and the same process as in Example 1 was executed.

Example 5

As shown in Table 1, an extrusion die 10 was prepared in the same manner as in Example 1 except that the inclination angle θ of the porthole 24 was set to 35°, Then, the extrusion die 10 was set to the same extruder as in Example 1, and the same process as in Example 1 was executed.

Example 6

As shown in Table 1, an extrusion die 10 was prepared in the same manner as in Example 1 except that the inclination angle θ of the porthole 24 was set to 35°, Then, the extrusion die 10 was set to the same extruder as in Example 1, and the same process as in Example 1 was executed.

Comparative Example

A bridge type extrusion die in which the diameter was 60 mm, the height (the length in the extrusion direction) was 50 mm, the occupied volume had the same as the extrusion die of the aforementioned example and the billet pressure receiving face was perpendicular to the extrusion direction was prepared.

As a male die of this extrusion die, a male die in which the height (thickness) of the mandrel was 2.0 mm, the width of the mandrel was 19.2 mm, the height of the passage forming protrusion was 1.2 mm, the width of the passage forming protrusion was 0.6 mm, and the width of the partition forming groove was 0.2 mm was used. Furthermore, as a female die 40, a female die in which the height (thickness) of the die hole was 1.7 mm, and the width of the die hole was 20.0 mm was used.

The inclination angle θ of the metallic material introduction direction to the central axis was substantially 0°.

Then, using this extrusion die, an extrusion molding was executed in the same manner as in Example 1, and the extrusion load N and the die life were measured and the die life limiting factor was also investigated in the same manner as mentioned above. The results are also shown in Table 1.

Evaluation of Examples 1 to 6 and Comparative Example

As shown in Table 1, the results show that Examples 1 to 6 are long in die life and excellent in durability as compared with Comparative Example.

Among Examples, in the extrusion die relatively small in inclination angle θ of the porthole (Example 1), although the extrusion load was small, the cracks of the male die became a die life factor and the die life was relatively short.

In the extrusion die relatively large in inclination angle θ of the porthole (Example 6), the wear of the male die became a die life factor. Although the die life was long, since extrusion load was large, the load during the operation of the extruder was relatively large.

On the other hand, in the extrusion die in which the inclination angle θ of the porthole was 10 to 35° (Examples 2 to 5), the extrusion load was suitable, the wear of the male die became a die life, and the die life was long enough.

TABLE 2

| | Spherical size of billet pressure receiving surface | Die life (Ton/die) |
|---|---|---|
| Example 7 | ⅛ | 1.2 |
| Example 8 | ⅙ | 2.0 |
| Example 9 | ⅓ | 2.5 |
| Example 10 | ½ | 3.0 |
| Example 11 | ⅚ | 3.0 |
| Example 12 | ⅚ | 3.0 |

Example 7

As shown in Table 2, in accordance with the aforementioned embodiment, a die holding case 20 in which the billet pressure receiving surface 22 was constituted by an external surface (convex spherical surface) of a ⅛ sphere and the curved surface radius was set to 45.4 mm was prepared. The diameter of this dome portion 21 was adjusted to 60 mm.

The die holding case 20 had two portholes 24 and 24, and the inclination angle θ of the central axis A2 of the porthole 24 to the central axis A1 of the die holding case 20 was adjusted to 25°.

As the male die 30, a male die in which the height (thickness) of the mandrel 31 was 2.0 mm, the width of the mandrel 31 was 19.2 mm, the height of the passage forming protrusion 33 was 1.2 mm, the width of the passage forming protrusion 33 is 0.6 mm, and the width of the partition forming groove 32 was 0.2 mm was used. Furthermore, as a female die 40, a female die in which the height of the die hole 41 was 1.7 mm and the width of the die hole 41 was 20.0 mm was used.

This extrusion die 10 was set to an extruder similar to the extruder shown in the aforementioned embodiment as shown in FIGS. 7 to 9, and extrusion molding was performed to manufacture a hollow member (heat exchanging tube 60) having a cross-sectional configuration corresponding to the extrusion hole 11 defined by and between the male die 30 and the female die 40.

Then, the die life (ton/die) was measured. The results are shown in Table 2.

Example 8

As shown in Table 2, an extrusion die 10 which was the same as the extrusion die in Example 7 except that the billet pressure receiving surface 22 was constituted by a convex spherical surface of a ⅙ sphere and the radius of the spherical surface was set to 40.3 mm was prepared, and set to the same extruder as mentioned above. Then, the same process was executed.

Example 9

As shown in Table 2, an extrusion die 10 which was the same as the extrusion die in Example 7 except that the billet pressure receiving surface 22 was constituted by a convex spherical surface of a ⅓ sphere and the radius of the spherical surface was set to 32.0 mm was prepared, and set to the same extruder as mentioned above. Then, the same process was executed.

Example 10

As shown in Table 2, an extrusion die 10 which was the same as the extrusion die in Example 7 except that the billet pressure receiving surface 22 was constituted by a convex spherical surface of a ½ sphere and the radius of the spherical surface was set to 30.0 mm was prepared, and set to the same extruder as mentioned above. Then, the same process was executed.

Example 11

As shown in Table 2, an extrusion die 10 which was the same as the extrusion die in Example 7 except that the billet pressure receiving surface 22 was constituted by a convex spherical surface of a ⅚ sphere and the radius of the spherical surface was set to 32.0 mm was prepared, and set to the same extruder as mentioned above. Then, the same process was executed.

Example 12

As shown in Table 2, an extrusion die 10 which was the same as the extrusion die in Example 7 except that the billet pressure receiving surface 22 was constituted by a convex spherical surface of a ⅚ sphere and the radius of the spherical surface was set to 40.3 mm was prepared, and set to the same extruder as mentioned above. Then, the same process was executed.

Evaluation of Examples 7 to 12

As shown in Table 2, in the extrusion die in which the radius of the spherical surface of the billet pressure receiving surface 22 was large and the projected amount was relatively small (Example 7), the die life was somewhat shortened.

Furthermore, in the extrusion die in which the radius of the spherical surface of the billet pressure receiving surface 22 was relatively large (Example 12), a longer die life was secured. However, it is considered that the processing of the billet pressure receiving surface is difficult.

On the other hand, in the extrusion die in which the billet pressure receiving surface 22 was set to an appropriate convex spherical surface, i.e., it was set to a convex spherical surface of ⅙ to ⅚ sphere (Examples 8 toll), the die life could be extended and the die production cost could be reduced. Among other things, especially in the extrusion die in which the billet pressure receiving surface 22 was set to a convex spherical surface of a ½ sphere (Example 10), the die production cost could be reduced while securing sufficient die life, resulting in excellent results.

As compared with Example 10, in the extrusion die in which the billet pressure receiving surface 22 was set to a convex spherical surface of a ⅚ sphere (Example 11), the die production cost increased, resulting in a slightly deteriorated result among Examples 8 to 11.

INDUSTRIAL APPLICABILITY

The extrusion die for metallic material according to the present invention can be applied to manufacture, e.g., a heat exchanging tube for use in a heat exchanger for, e.g., car air conditioners.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

The invention claimed is:

1. An extrusion die for metallic material, comprising:

a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in a periphery of the dome portion, a central axis of the porthole is inclined to a central axis of the die holding case so that the central axis of the porthole gradually approaches the central axis of the die holding case toward a downstream side, the dome portion has a front end wall portion which is formed continuously in a peripheral direction of the dome portion, the metallic material pressed against the metallic material pressure receiving surface is introduced into the die holding case through the porthole and passes through the extrusion hole, and an inner side surface and an outer side surface on an inner periphery of the porthole are positioned approximately in parallel with each other and approximately in parallel to the central axis of the porthole.

2. The extrusion die for metallic material as recited in claim 1, wherein the metallic material pressure receiving surface is constituted by a convex spherical surface which is a part of a spherical surface.

3. The extrusion die for metallic material as recited in claim 1 or 2, wherein the metallic material pressure receiving surface is constituted by a convex spherical surface of a ⅙ to ⅚ sphere.

4. The extrusion die for metallic material as recited in claim 1, wherein a plurality of portholes are formed about the central axis of the die holding case at regular intervals in a peripheral direction of the die holding case.

5. The extrusion die for metallic material as recited in claim 1, wherein the porthole is arranged toward the extrusion hole.

6. The extrusion die for metallic material as recited in claim 1, wherein the central axis of the porthole is set to 10 to 35° in inclination angle to the central axis of the die holding case.

7. The extrusion die for metallic material as recited in claim 1, wherein a flat circular extrusion hole small in height with respect to a width is formed by and between the mandrel of the male die and the die hole of the female die, and a portion of the mandrel corresponding to the die hole is formed into a comb configuration having a plurality of passage forming protrusions arranged in a width direction, whereby the metallic material is passed through the extrusion hole to thereby extrude a multi-bored hollow member having a plurality of passages arranged in a width direction.

8. The extrusion die for metallic material as recited in claim 7, wherein the multi-bored hollow member is a heat exchanging tube for a heat exchanger.

9. The extrusion die for metallic material as recited in claim 1, wherein a flat circular extrusion hole small in height with respect to a width is formed by and between the mandrel of the male die and the die hole of the female die, and wherein the portholes are arranged at positions corresponding to both sides in a height direction of the extrusion hole.

10. The extrusion die for metallic material as recited in claim 1, wherein the die holding case has, at a front portion with respect to the extrusion direction, a circular base portion integrally formed with the dome portion.

11. The extrusion die for metallic material as recited in claim 1, wherein the metallic material is aluminum or an alloy of aluminum.

12. An extrusion die for extruding a heat exchanging tube having a plurality of passages arranged in a width direction, the extrusion die comprising:

a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in a periphery of the dome portion, and a central axis of the porthole is inclined to a central axis of the die holding case so that the central axis of the porthole gradually approaches the central axis of the die holding case toward a downstream side, a portion of the mandrel corresponding to the die hole is formed into a comb configuration having a plurality of passage forming protrusions, the dome portion has a front end wall portion which is formed continuously in a peripheral direction of the dome portion, the metallic material pressed against the metallic material pressure receiving surface is introduced into the die holding case through the porthole and passes through the extrusion hole to thereby form the heat exchanging tube having a plurality of passages arranged in the width direction, and an inner side surface and an outer side surface on an inner periphery of the porthole are positioned approximately in parallel with each other and approximately in parallel to the central axis of the porthole.

13. A method of extruding metallic material, comprising:

preparing a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material, a male die having a mandrel held in the die holding case and positioned on a central axis of the die holding case, and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in a periphery of the dome portion, the dome portion has a front end wall portion which is formed continuously in a peripheral direction of the dome portion, a central axis of the porthole is inclined to a central axis of the die holding case so that the central axis of the porthole gradually approaches the central axis of the die holding case toward a downstream side, and an inner side surface and an outer side surface on an inner periphery of the porthole are positioned approximately in parallel with each other and approximately in parallel to the central axis of the porthole; and introducing the metallic material pressed against the metallic material pressure receiving surface into the die holding case through the porthole to pass through the extrusion hole.

14. An extrusion method for manufacturing a heat exchanging tube having a plurality of passages arranged in a width direction of the heat exchanging tube, the extrusion method comprising:

preparing a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material, a male die having a mandrel held in the die holding case and positioned on a central axis of the die holding case, and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in, a periphery of the dome portion, the dome portion has a front end wall portion which is formed continuously in a peripheral direction of the dome portion, a central axis of the porthole is inclined to a central axis of the die holding case so that the central axis of the porthole gradually approaches the central axis of the die holding case toward a downstream side, a portion of the mandrel corresponding to the die hole is formed into a comb configuration having a plurality of passage forming protrusions, and an inner side surface and an outer side surface on an inner periphery of the porthole are positioned approximately in parallel with each other and approximately in parallel to the central axis of the porthole; and introducing the metallic material pressed against the metallic material pressure receiving surface into the die holding case through the porthole to pass through the extrusion hole to thereby form the heat exchanging tube having a plurality of passages arranged in a width direction.

15. An extruder for metallic material equipped with a container and an extrusion die mounted in the container in which the metallic material is supplied to the extrusion die, wherein the extrusion die comprises:

a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in a periphery of the dome portion, the dome portion has a front end wall portion which is formed continuously in a peripheral direction of the dome portion, a central axis of the porthole is inclined to a central axis of the die holding case so that the central axis of the porthole gradually approaches the central axis of the die holding case toward a downstream side, the metallic material pressed against the metallic material pressure receiving surface pressed is introduced into the die holding case through the porthole and passes through the extrusion hole, and an inner side surface and an outer side surface on an inner periphery of the porthole are positioned approximately in parallel with each other and approximately in parallel to the central axis of the porthole.

16. An extruder for producing a heat exchanging tube equipped with a container and an extrusion die mounted in the container in which the metallic material is supplied to the extrusion die, wherein the extrusion die comprises:

a die holding case having a dome portion and a base portion, the dome portion having an external surface configured to be a metallic material pressure receiving surface, the metallic material pressure receiving surface of the dome portion being disposed so as to face rearward with respect to an extrusion direction of the metallic material;

a male die having a mandrel held in the die holding case and positioned on a central axis of the die holding case; and a female die held in a front portion of the die holding case, the female die having a die hole for defining an extrusion hole by and between the female die and the mandrel, wherein the metallic material pressure receiving surface of the dome portion is formed into a convex configuration protruded rearward, a porthole for introducing the metallic material is formed in a periphery of the dome portion, and a central axis of the porthole is inclined to a central axis of the die holding case so that the central axis of the porthole gradually approaches the central axis of the die holding case toward a downstream side, the dome portion has a front end wall portion which is formed continuously in a peripheral direction of the dome portion, a portion of the mandrel corresponding to the die hole is formed into a comb configuration having a plurality of passage forming protrusions, the metallic material pressed against the metallic material pressure receiving surface is introduced into the die holding case through the porthole and passes through the extrusion hole to thereby form the heat exchanging tube having a plurality of passages arranged in a width direction, and an inner side surface and an outer side surface on an inner periphery of the porthole are positioned approximately in parallel with each other and approximately in parallel to the central axis of the porthole.

17. An extrusion die for metallic material, comprising:

a die case having a dome portion and the base portion, the dome portion having an external surface configured to be a metallic material pressure receiving surface, the metallic material pressure receiving surface of the dome portion being disposed so as to face rearward with respect to an extrusion direction of the metallic material;

a male die held in the die case and positioned on a central axis of the die case; and a female die held in a front portion of the die case, the female die defining an extrusion hole by and between the female die and the male die, wherein the metallic material pressure receiving surface of the dome portion is formed into a convex configuration protruded rearward, a porthole for introducing the metallic material is formed in a periphery of the dome portion, the dome portion has a front end wall portion which is formed continuously in a peripheral direction of the dome portion, a central axis of the porthole is inclined to a central axis of the die case so that the central axis of the porthole gradually approaches the central axis of the die case toward a downstream side, the metallic material pressed against the metallic material pressure receiving surface pressed is introduced into the die case through the porthole and passes through the extrusion hole, and an inner side surface and an outer side surface on an inner periphery of the porthole are positioned approximately in parallel with each other and approximately in parallel to the central axis of the porthole.

* * * * *